United States Patent [19]

Furusawa et al.

[11] Patent Number: 4,669,435

[45] Date of Patent: Jun. 2, 1987

[54] EXHAUST BRAKE CONTROL SYSTEM

[75] Inventors: Choji Furusawa, Okazaki; Shigeki Goto, Toyota; Satoshi Maruchi, Toyota; Isamu Minemoto, Toyota, all of Japan

[73] Assignee: Aisin Seiki Kabushiki Kaisha, Kariya, Japan

[21] Appl. No.: 860,036

[22] Filed: May 6, 1986

[30] Foreign Application Priority Data

May 8, 1985 [JP] Japan ..... 60-097268

[51] Int. Cl.[4] ..... F02D 9/06

[52] U.S. Cl. ..... 123/323; 188/273

[58] Field of Search ..... 123/323; 188/273; 74/861, 865, 843

[56] References Cited

U.S. PATENT DOCUMENTS

| | | | |
|---|---|---|---|
| 4,114,575 | 9/1978 | Nohira et al. | 188/273 |
| 4,149,618 | 4/1979 | Horie | 188/273 |
| 4,354,464 | 10/1982 | Fujita | 123/323 |
| 4,426,986 | 1/1984 | Müller et al. | 123/323 |
| 4,557,233 | 12/1985 | Joppig et al. | 123/323 |

FOREIGN PATENT DOCUMENTS

| | | | |
|---|---|---|---|
| 58-28414 | 6/1983 | Japan . | |
| 158364 | 9/1984 | Japan | 123/323 |

*Primary Examiner*—William A. Cuchlinski, Jr.
*Attorney, Agent, or Firm*—Burns, Doane, Swecker & Mathis

[57] ABSTRACT

An exhaust brake control system includes an input switch for commanding actuation of an exhaust brake, a throttle sensor for sensing that an accelerator pedal has been depressed in excess of a predetermined angle, a control unit for outputting a control signal in dependence upon output signals from the input switch and throttle sensor, and a valve means for opening and closing an exhaust passageway in dependence upon a control signal produced by the control unit. The control unit includes a shift sensor for sensing at least an L-range shift of an automatic transmission, and a servo hydraulic pressure sensor for sensing servo hydraulic pressure that actuates a servo piston for establishing 1st speed range. When the shift sensor senses that the automatic transmission has been shifted to the L range, the control unit outputs a control signal for actuating the valve means to open the exhaust gas passageway at such time that the servo hydraulic pressure sensor outputs a signal indicative of a value greater than a predetermined value. Exhaust braking is applied following attainment of a sufficiently high servo hydraulic pressure immediately after a downshift, thus preventing the engine from stopping at application of exhaust braking. The same is applied to downshifting to "2" range.

13 Claims, 5 Drawing Figures

EXHAUST BRAKE CONTROL SYSTEM

BACKGROUND OF THE INVENTION

This invention relates to an exhaust brake control system and, more particularly, to an exhaust brake control system for an automotive vehicle equipped with an automatic transmission.

An exhaust brake control system installed in an automotive vehicle equipped with an automatic transmission is well-known in the art. For example, the specification of Japanese Patent Kokoku Publication No. 58-28414 describes an exhaust brake control system in which an exhaust brake is controlled by signals from an exhaust brake switch (hereafter referred to as an input switch) provided on the vehicle instrument panel or the like, a throttle switch actuated in dependence upon the amount by which the vehicle accelerator pedal is depressed, and a shift switch actuated by manual control of the automatic transmission.

The disclosed arrangement is particularly directed to freeing the driver from the troublesome task of operating the input switch when necessary by enabling the shift switch actuated by manual operation of the automatic transmission to be used an an exhaust brake starting switch. However, merely providing the shift switch as proposed by the cited invention is not enough to improve the performance of the exhaust brake. For example, when the arrangement is applied to an automatic transmission of the kind shown in FIG. 4, if the driver shifts to "2" to "L" manual select range when performing a downshift, the automatic transmission is in a so-called "neutral" state until any of prescribed servo piston cylinders is filled with the oil producing the servo hydraulic pressure that establishes the 2nd or 1st speed range, respectively, of the automatic transmission. When the abovementioned downshift to "2" or "L" manual select range is made, in the neutral state there is the possibility that the engine will stop running.

SUMMARY OF THE DISCLOSURE

Accordingly, an object of the present invention is to provide an exhaust brake control system adapted to avoid stopping of the engine while effectively actuating the exhaust brake.

According to the present invention, the foregoing object is attained by controlling the starting of exhaust braking through use of a shift sensor for sensing range shift into one of manual select ranges, and a servo hydraulic pressure sensor for sensing hydraulic pressure that actuates a rear servo piston, namely by providing an exhaust brake control system comprising an input switch for commanding actuation of an exhaust brake, a throttle sensor for sensing that an accelerator pedal has been depressed in excess of a predetermined angle, a control means (unit) which receives signals produced by the input switch and throttle sensor for outputting a control signal in dependence upon these signals, and a valve means for opening and closing an exhaust passageway in dependence upon a control signal produced by the control unit. The control unit includes a shift sensor for sensing range shift of an automatic transmission into one of manual select ranges, and a servo hydraulic pressure sensor for sensing servo hydraulic pressure that actuates an actuator taking part of establishing at least one of lower speed ranges defined by said one of manual select ranges. When the shift sensor senses that the automatic transmission has been shifted down to said one of lower manual select ranges, the control means (unit) outputs a control signal for acutating the valve means to open the exhaust gas passageway at such time that the servo hydraulic pressure sensor outputs a signal indicative of a value greater than a predetermined value.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

The principle of the exhaust brake control system according to the present invention will now be described with reference to the block diagram of FIG. 1.

Figure 1:
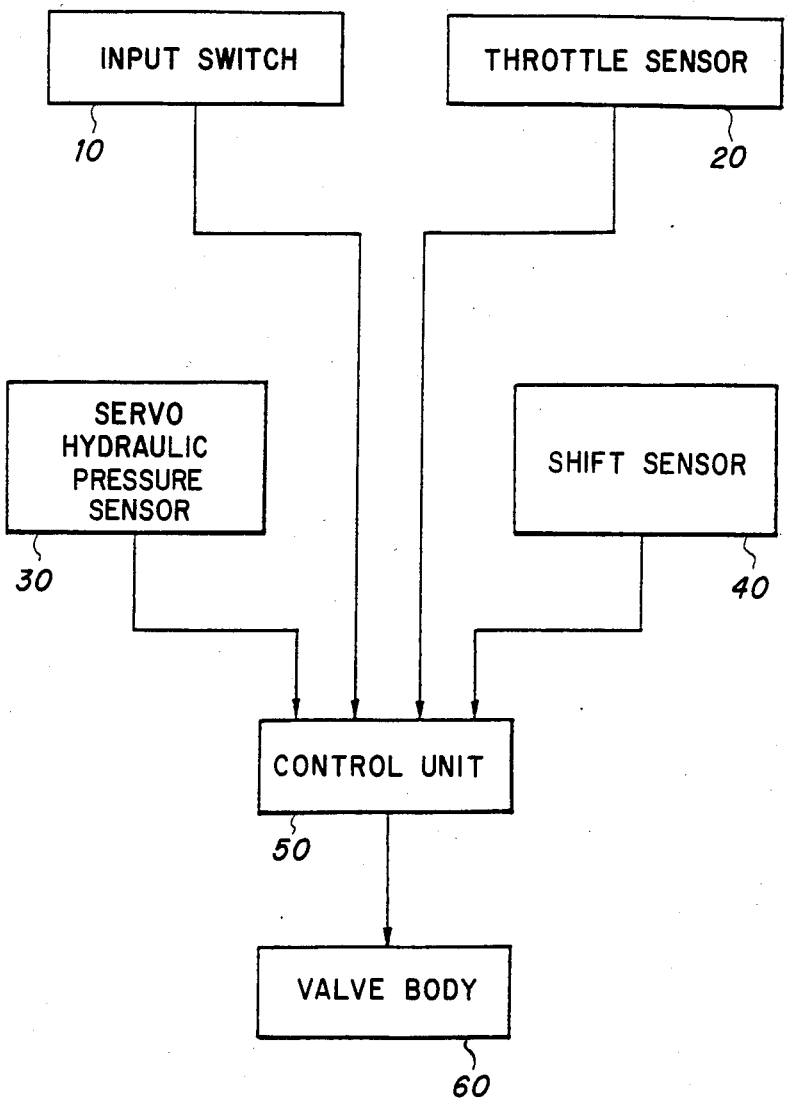
FIG. 1 is a block diagram useful in describing the principle of the present invention.

As shown in FIG. 1, the exhaust brake control system includes an input switch 10 for issuing a command signal that actuates an exhaust brake. Preferably, the input switch 10 is constituted by, for example, a manually operated push-button switch or slide switch, but a switch operated by foot pressure can also be employed. Other specific examples of the input switch 10 are a voice-actuated device for issuing the command signal in response to the driver's voice, and a device adapted to sense the angle of inclination of the road surface as well as the velocity of the vehicle and issue the command signal based on the results of what is sensed.

The control system also includes a throttle sensor 20 for sensing that the accelerator pedal of the vehicle has been depressed in excess of a predetermined angle from an initial position. Preferably, the signal outputted by the throttle sensor 20 is an electric signal, though it is also possible to utilize a signal produced by fluid pressure, such as hydraulic or pneumatic pressure. The signals in both cases can be in either analog or digital form. Where the output from the throttle sensor 20 is an electric signal, the sensor 20 may comprise, e.g., a microswitch, a position meter or a piezoelectric element of the type that produces an output signal in response to pressure from a flexible or resilient member. It is also possible to utilize a pressure switch actuated by fluid pressure, or the actuating force of a piston caused to travel in a cylinder as by fluid pressure.

The control system is also provided with a servo hydraulic pressure sensor 30 for sensing servo hydraulic pressure that actuates at least one servo piston or establishing at least one predetermined lower speed range (e.g., a rear servo piston B2 or the like) of an automatic transmission. Examples of the servo hydraulic pressure sensor 30 are a pressure switch, piezoelectric element and the like. Also provided is a shift sensor 40 for sensing at least that a shift lever of the automatic transmission has been selected to at least one or lower manual select ranges, e.g., the L range. Examples of the shift sensor 40 are a microswitch, a sliding resistor, a piezoelectric element, a light-receiving element picking up light from a light-emitting element, a proximity switch or the like.

Signals produced by the input switch 10, throttle sensor 20, servo hydraulic pressure sensor 30 and shift sensor 40 are fed into a control unit 50 which, on the basis of these input signals, outputs a control signal for actuating the exhaust brake in such a manner that the vehicle engine will not stop. The control unit 50 preferably is constituted by an electric circuit, though it is also possible to utilize a fluid control circuit which uses fluid elements. Where the electric circuit is used, the control unit 50 may comprise a microcomputer, comparators or the like. If the fluid control circuit is adopted, the control unit 50 may comprise a well-known fluid controller.

The output of the control unit 50 is connected to a valve means 60 arranged in a passageway for the exhaust gas discharged by the vehicle engine, and is adapted to control the amount of exhaust gas that flows through the passageway. Examples of the valve means 60 are an electromagnetic directional control valve, an electromagnetic flow control valve, or a disc valve (or barrier plate) rotated by a rotary machine.

In operation, assume that the vehicle is traveling in "2" range position on a horizontal road surface but is about to begin descending a long, steep downgrade. When the vehicle nears the downgrade, the driver eases back on the accelerator pedal. This is sensed by the throttle sensor 20, which provides the control unit 50 with a signal corresponding to the amount of accelerator pedal depression. The driver then shifts the manual select range to the L position. This is sensed by the shift sensor 40, which responds by providing the control unit 50 with a signal indicating that the lever of the automatic transmission is in the L-range position. Next, the driver closes the input switch 10, which is for starting the exhaust brake, installed on the lower side of the instrument panel in front of the driver's seat. When thus closed, the input switch 10 provides the control unit 50 with a signal commanding the start of exhaust braking. In the above process, the automatic transmission is in the neutral state until the rear servo piston cylinder of an actuator for establishing the 1st speed range is filled with the fluid producing the servo hydraulic pressure that establishes the 1st speed range of the automatic transmission. Accordingly, the control unit 50 does not yet provide the valve means 60 with a control signal that actuates the exhaust brake. However, if the amount by which the accelerator pedal is depressed falls below a prescribed value and the servo hydraulic pressure becomes a prescribed value or higher upon passage of a predetermined period of time, the control unit 50 delivers the brake actuating control signal to the valve means 60. The latter responds to this control signal by narrowing the passage through which the exhaust gas from the engine flows. Accordingly, since the control signal is delivered to the valve means 60 at an opportune time, exhaust braking is effected without causing the engine to stop.

When the long, steep downgrade ends and the vehicle reaches a horizontal road surface, the driver steps down on the accelerator pedal by an amount greater than that which prevailed on the downgrade. When the signal from the throttle sensor 20 indicating the amount of accelerator pedal depression exceeds a prescribed value, the control unit 50 provides the valve means 60 with a control signal for terminating exhaust braking. The valve means 60 responds to this control signal by releasing the exhaust brake.

Let us now describe a specific embodiment of the present invention in detail.

Figure 2:
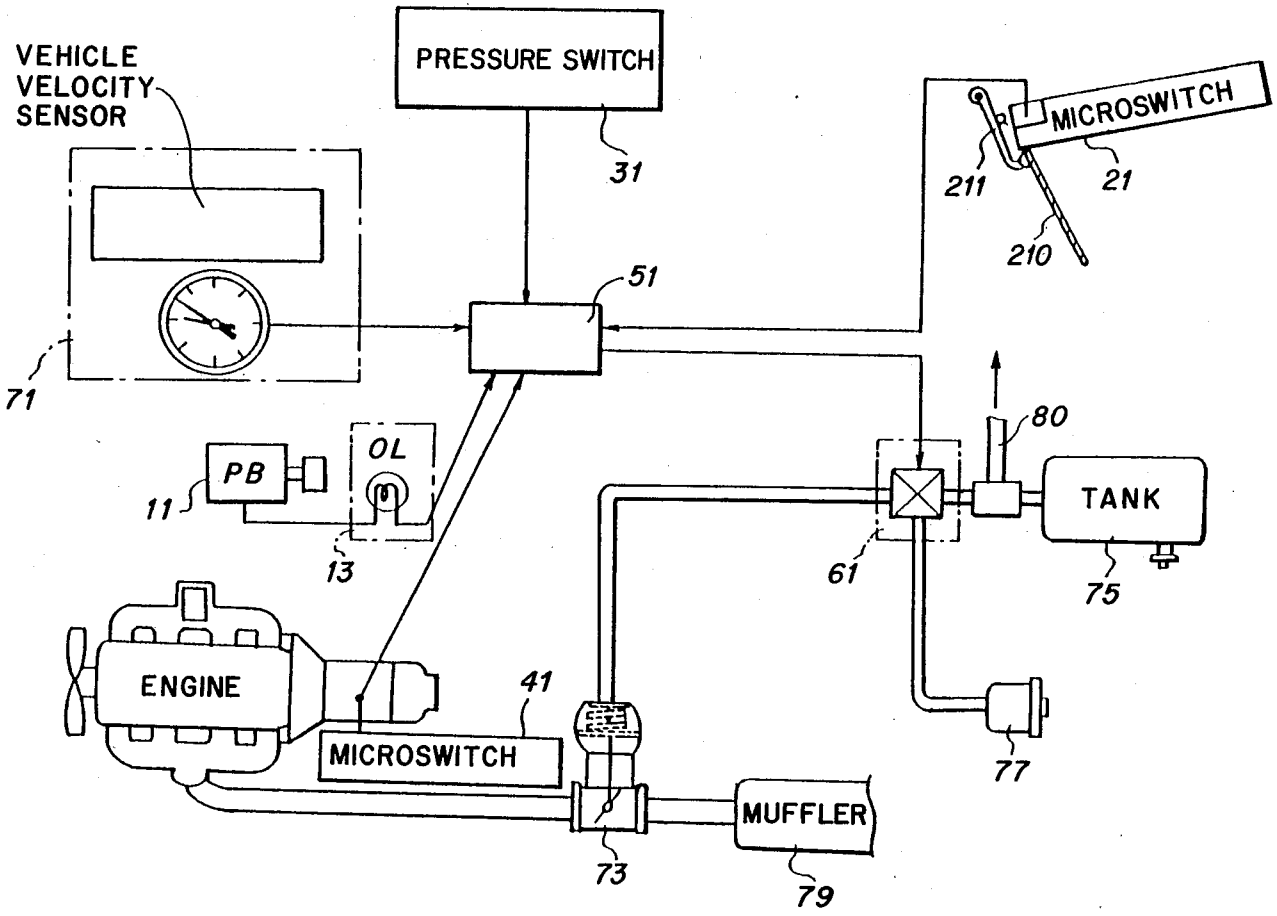
FIG. 2 is a block diagram useful in describing an exhaust brake control system embodying the present invention.

FIG. 2 is a block diagram useful in describing an exhaust brake control system embodying the present invention. In the illustrated embodiment, a memorizing-type push-button switch 11 serves as the aforementioned input switch and is connected to a lamp 13 for indicating that the input switch has been closed. The aforementioned throttle sensor 20 is constituted by a microswitch 21 actuated when an arm 211 operatively associated with an accelerator pedal 210 is moved in excess of a predetermined angle. The servo hydraulic pressure sensor comprises a pressure switch 31 which, when hydraulic pressure driving the rear servo piston of the automatic transmission exceeds a value of 1.5 $kg/cm^2$, undergoes a transition from an open state to a closed state and produces output signals indicative of these two states. The shift sensor comprises a microswitch 41 which, when the shift lever has been set in the L-range, is closed to produce an output signal indicative of the closed state.

In order to improve the performance of the control system, there is provided a vehicle velocity sensor for outputting a reversed signal when the velocity of the vehicle is 15 km/h.

The valve means 60 comprises a three-position exhaust brake electromagnetic valve 61. The valve 61 is provided in an exhaust braking circuit to which are connected an exhaust retarder 73, an exhaust muffler 79, a vacuum tank 75, an air cleaner 77, and a vacuum pump connection port 80.

Numeral 51 designates the aforementioned control unit to which the starting switch 11, throttle sensor (microswitch) 21, servo hydraulic pressure sensor (pressure switch) switch 31, shift sensor (microswitch) 41, valve 61 and velocity sensor 71 are connected.

Figure 3:
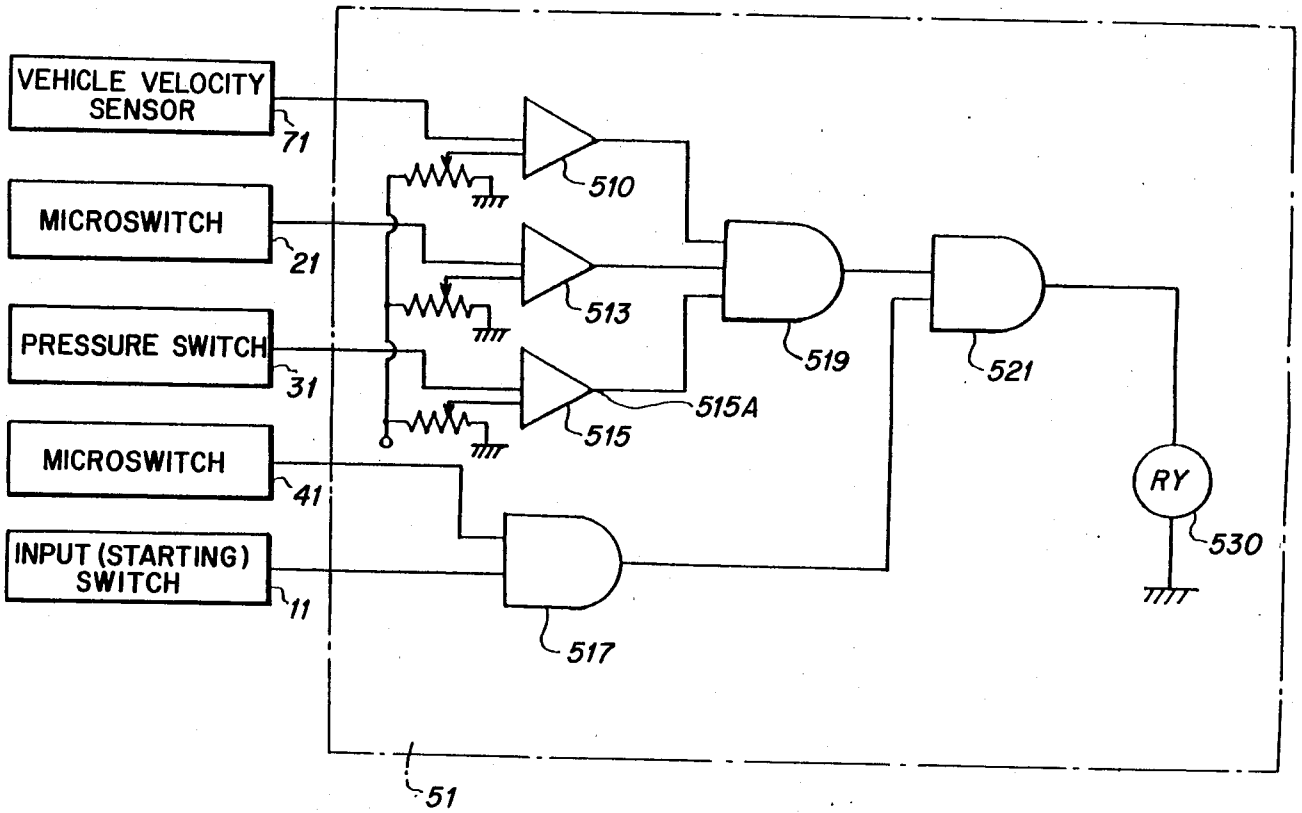
FIG. 3 is a detailed block diagram of a control unit employed in the embodiment of the system shown in FIG. 2.

The construction of the control unit 51 is shown in detail in FIG. 3. The control unit 51 comprises comparators 510, 513, 515 to which the signals from the velocity sensor 71, throttle sensor 21 and servo hydraulic pressure sensor 31 are respectively applied, an AND gate 519 for producing a high-level output when the signals from the comparators 510, 513, 515 attain the high level simultaneously, an AND gate 517 for producing a high-level output when the signals from both the shift sensor 41 and starting switch 11 are high, an AND gate 521 to which the output signals from the AND gates 517, 519 are applied, and a relay 530 to which the output of the AND gate 521 is applied. It will be understood that when the outputs from the elements 21, 31, 41, 71 are high simultaneously, the output of the AND gate 521 will be high and, hence, the relay 530 will close, thereby producing the output signal of the control unit 51. The shift sensor 41 senses a down shift to a prescribed select range ("2" or "L" range).

Figure 4:
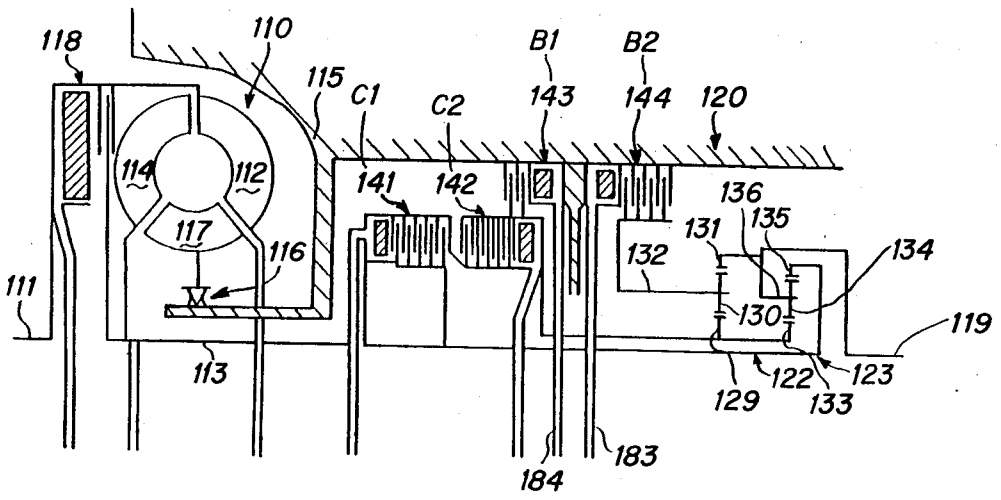
FIG. 4 is a view showing the structure of an automatic transmission used in the system of the illustrated embodiment.

Let us now refer to FIG. 4 to describe the transmission used in the control system of the illustrated embodiment.

In FIG. 4, numeral 110 denotes a well-known three-element, single-stage, two-phase torque converter comprising a pump impeller 112 coupled to an engine output shaft 111, a turbine runner 114 coupled to an input shaft 113 of a transmission 120, described below, and a stator wheel 117 supported via a one-way brake 116. The torque converter 110 is internally provided with a high-gear clutch 118 (lock-up clutch) 118 directly coupled with the pump impeller 112 and turbine runner 114, namely the engine output shaft 111 and the input shaft 113 of the transmission 120. The transmission 120 has an output shaft 119 provided rearwardly of the input shaft 113 in concentric relation therewith. Arranged between the input shaft 113 and output shaft 119 are, in the order mentioned, a first planetary gear set 122, and second planetary gear set 123, both of single pinion type.

The first planetary gear set 122 includes a second sun gear 129, a first planetary gear 130, a first ring gear 131 and a first carrier 32; the second planetary gear set 123 includes a second sun gear 133, a second planetary gear 134, a second ring gear 135 and a second carrier 136. A first clutch 141 is arranged between the second ring gear 135 and input shaft 113.

The first sun gear 129 and second sun gear 133 are secured to one another so as to be capable of rotating in unison. A second clutch 142 is arranged between these sun gears and the input shaft 113. The first and second sun gears 129 and 133 are capable of being fixed against motion to a case 115 of the transmission 120 by a first brake (B1) 143. The first carrier 132 is capable of being fixed against motion to the case 115 of the transmission 120 by a second brake (B2) 144. The first ring gear 132 is connected to the second carrier 136 and further connected to an output shaft 119.

In the above gear train, first speed (gear) range in forward is achieved when the first clutch (C1) 141 and second brake (B2) 144 are engaged; second speed range in forward is achieved when the first clutch (C1) 141 and first brake (B1) 143 are engaged; third speed range in forward is achieved when the first clutch (C1) 141 and second clutch (C2) 142 are engaged while lock-up direct gear drive in forward is achieved when additionally the lock-up clutch 118 is engaged; and reverse drive is achieved when the second clutch (C2) 142 and second brake (B2) 144 are engaged.

The operation of this gear train is summarized in a Table below:

| speed range | C1 141 | C2 142 | B1 143 | B2 144 | lock-up clutch 118 |
|---|---|---|---|---|---|
| Forward | | | | | |
| L/U | X | X | | | X |
| 3 | X | X | | | |
| 2 | X | | X | | |
| 1 | X | | | X | |
| Reverse | | X | | X | |

X: actuated state

Further, the relation of the manual select ranges with the speed ranges is as follows:

| Manual select ranges | Speed ranges |
|---|---|
| D | L/U |
| | 3 |
| | 2 |
| | 1 |
| 3 | 3 |
| | 2 |
| | 1 |
| 2 | 2 |
| | 1 |

-continued

| Manual select ranges | Speed ranges |
|---|---|
| L | 1 |
| N | Neutral |
| R | Reverse |
| P | Parking |

Figure 5:
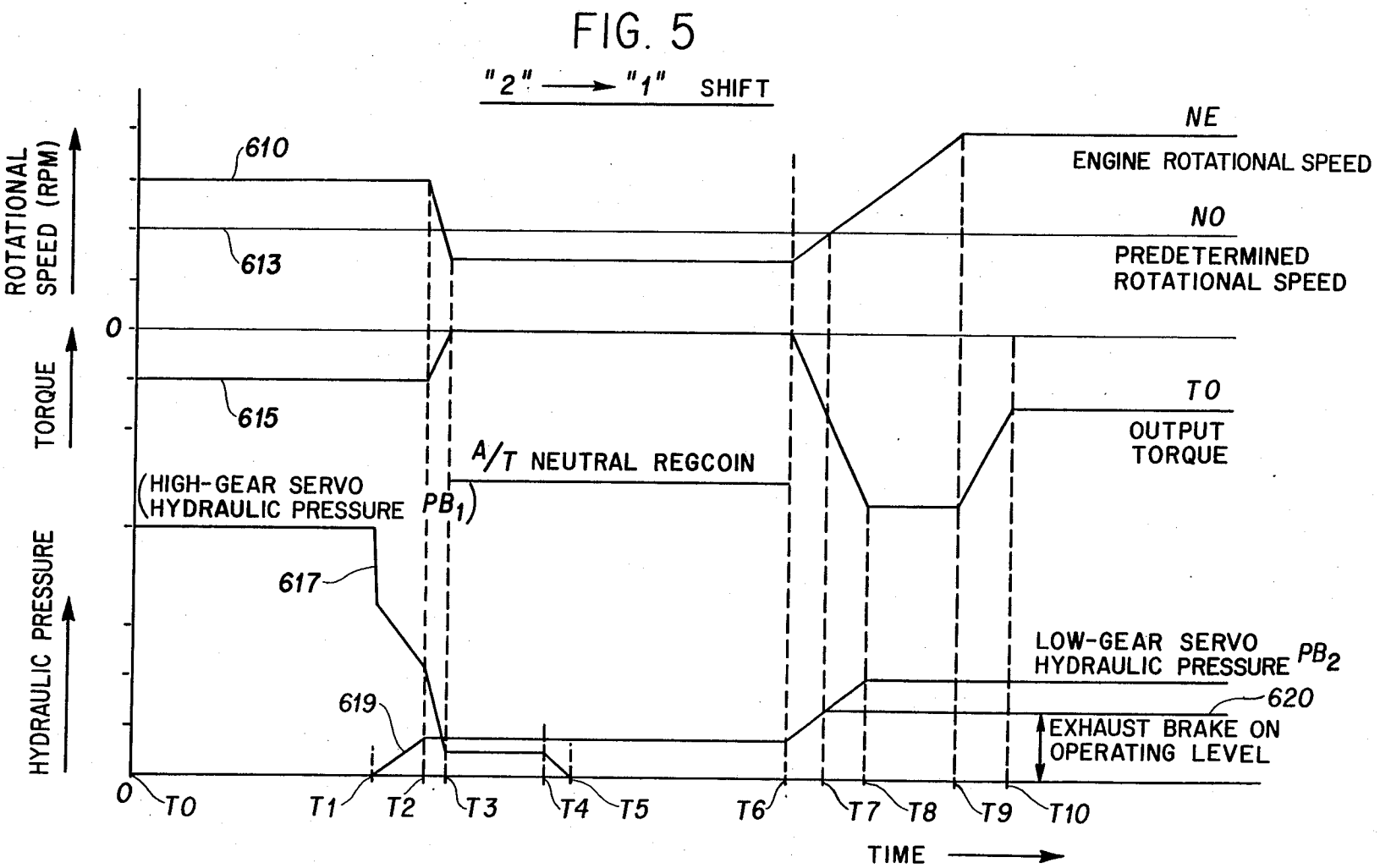
FIG. 5 is a timing chart for describing how rear servo hydraulic pressure changes with time.

Reference will now be had to the timing chart of FIG. 5 to describe the process through which pressure is sensed by the servo hydraulic pressure sensor, which is one specific embodiment of the control system according to the present invention, wherein down shifting from "2" to "L" select range is disclosed.

In FIG. 5, the horizontal axis illustrates elapsed time, and the vertical axis illustrates the temporal change in engine rotational speed (rpm) NE, rotary torque TO of the output shaft of the automatic transmission, as well as high-gear hydraulic pressure PB1 (line 184) and low-gear hydraulic pressure PB2 (line 183) for actuating front and rear pistons (B1, B2), respectively. At a time t=T0, the exhaust braking command push-button switch 11 is pressed, with the driver having already backed off the accelerator pedal. Under these conditions, engine braking is in effect. At t=T1, the driver shifts the shift lever of the automatic transmission down from "2" to "L". The engine rotational speed NE and transmission output shaft rotational speed are at constant values at this time. Since the driver has performed the downshift by manipulating the shift lever, the amount of oil in the front piston cylinder decreases, high-gear hydraulic pressure drops and the rear piston cylinder begins to rise. At t=T2, filling of the rear piston cylinder with oil is completed and, hence, engine rpm NE decreases, as a result of which the output torque TO begins to rise. Both NE and TO attain respective predetermined values at t=T3. High-gear servo hydraulic pressure PB1 also assumes a constant value at this time, and the automatic transmission enters the neutral region. High-gear hydraulic pressure begins falling from t=T4, which is a prescribed period of time after t=T3, and drops to a value of zero at t=T5. If exhaust braking is effected in the region defined by $T3 \leqq t < T6$, the engine stops because low-gear servo hydraulic pressure PB2 is such that a predetermined engine speed NO has not been attained. However, low-gear hydraulic pressure PB2 rises after t=T6 and, at t=T7, crosses a straight line 620 indicating that exhaust braking, set at the pressure switch 31, is capable of being carried out. Since the rotational speed NE of the engine is higher than a predetermined (idling) rotational speed NO from T7 onward, the engine will not stop when exhaust braking is applied. At t=T7, the engine rotational speed NE crosses the value of NO at which exhaust gas braking is capable of being applied. The low-gear servo hydraulic pressure at this time is 1.5 kg/cm$^2$. Owing to closure of the contacts of pressure switch (servo hydraulic pressure sensor) 31, the output of the pressure switch causes a high-level output to appear at an output terminal 515A of the comparator 515 in FIG. 3. At t=T9, the engine rotational speed NE levels off, whereupon the output torque T0 begins rising and levels off at t=T10.

In the embodiment of the present invention described above, the start of exhaust brake application is sensed by sensing servo hydraulic pressure. However, this can also be achieved by sensing the L range and the torque of the output shaft. This involves actuating the exhaust brake when a reverse driving force begins to be transmitted and a torque in excess of a predetermined value is sensed, without actuating the exhaust brake in the neutral region.

In accordance with the illustrated embodiment, an exhaust brake system is provided with control means comprising the microswitch for sensing the position to which the automatic transmission has been shifted, the pressure switch for sensing the low-gear servo hydraulic pressure, the microswitch for sensing the amount of accelerator pedal depression, and the input switch. This assures that exhaust braking will be applied following attainment of a sufficiently high rear servo hydraulic pressure immediately after the shift lever is downshifted. Therefore, unlike the prior art, there is no risk of the engine stopping at application of exhaust braking.

Thus, according to this embodiment, the provision of the input switch, throttle sensor, servo hydraulic pressure sensor, shift sensor and valve means enable detection of both an "L" shift signal and rear servo hydraulic pressure, thereby enabling stopping of the engine to be prevented even when exhaust braking is applied.

When a downshift is made to a lower range, exhaust braking is effected after the rear servo hydraulic pressure becomes sufficiently high, namely after sufficient transmission of a reverse driving force. Accordingly, the engine will not stop when the driver downshifts.

In the above embodiment, the "2"-"L" downshifting is disclosed in detail. However, a downshifting to "2" select range may be carried out similarly by reading the high and low gear servos (PB1, PB2) are the second clutch (C2) 142 and the first brake (B1), respectively in FIG. 5 subject to appropriate modification with respect to the shift sensor 40 which should now sense the down shift to the "2" select range. By this provision engine stop upon exhaust gas braking at downshifting from "D" or "3" range to "2" range can be avoided.

As many apparently widely different embodiments of the present invention can be made without departing from the spirit and scope thereof, it is to be understood that the invention is not limited to the specific embodiments thereof except as defined in the appended claims.

What is claimed is:

1. An exhaust brake control system for use with an automatic transmission of an automotive vehicle, comprising:

an input switch for producing an output signal commanding actuation of an exhaust brake;

a throttle sensor for producing an output signal upon sensing that an accelerator pedal of the vehicle has been depressed in excess of a predetermined angle;

control means which receives the output signals produced by said input switch and said throttle sensor for outputting a control signal in dependence upon these output signals; and a valve means for opening and closing an exhaust passageway of the vehicle in dependence upon the control signal produced by said control means;

said control means including a shift sensor for producing an output signal upon sensing that the automatic transmission has been shifted to at least one of lower manual select ranges, and a servo hydraulic pressure sensor for sensing servo hydraulic pressure that actuates an actuator taking part of establishing at least one of lower speed ranges defined by said one of manual shift ranges;

wherein when said shift sensor senses that the automatic transmission has been shifted down to said one of lower manual select ranges, said control means responds to the output signal from said shift sensor by outputting the control signal for actuating said valve means so as to open the exhaust gas passageway at such time that said servo hydraulic pressure sensor outputs a signal to said control means indicative of a value greater than a predetermined value.

2. The system according to claim 1, wherein said one of the lower manual select ranges includes an "L" range.

3. The system according to claim 1, wherein said one of the lower manual select ranges includes a "2" range.

4. The system according to claim 1, wherein said actuator is a servo piston acting on a friction engaging means for establishing said one of lower speed ranges.

5. The system according to claim 1, wherein said one of lower speed ranges includes 1st and/or 2nd speed range.

6. The system according to claim 1, wherein the control means includes an electric control unit.

7. The system according to claim 6, wherein said control unit further comprises:

a first comparator having an input side receiving the output signal from said throttle sensor and an output side;

a second comparator having an input side receiving the output signal from said servo hydraulic pressure sensor and an output side;

a first AND gate having an input side receiving the output signal from said shift sensor and the output signal from said input switch;

a second AND gate having an input side, to which the output sides of said first and second comparators are connected, and an output side; and a third AND gate having an input side, to which the output sides of said first and second AND gates are connected, and an output side; and a relay to which the output side of said third AND gate is connected;

said third AND gate producing a high-level output to close said relay, thereby producing the control signal of said control means, when said throttle sensor, said servo hydraulic pressure sensor, said shift sensor and said input switch produce their respective output signals simultaneously.

8. The system according to claim 1, wherein said input switch comprises a memorizing-type push-button switch.

9. The system according to claim 8, further comprising an indicating lamp connected between an output side of said push-button switch and an input side of said control means for indicating that said push-button switch has been closed.

10. The system according to claim 1, wherein said throttle sensor comprises a microswitch operatively associated with the accelerator pedal for being actuated when the accelerator pedal is depressed in excess of the predetermined angle.

11. The system according to claim 1, wherein said servo hydraulic pressure sensor comprises a pressure switch which, when hydraulic pressure driving the rear servo piston exceeds a predetermined value, is turned for producing the signal applied to said control means.

12. The system acccording to claim 1, wherein said shift sensor comprises a microswitch which, when a shift lever of the automatic transmission has been set in the "2" or "L"-range, is turned for producing the output signal applied to said control means.

13. The system according to claim 1, wherein said valve means comprises a three-position exhaust brake electromagnetic valve.

* * * * *